US011484067B2

(12) United States Patent
Dubose

(10) Patent No.: US 11,484,067 B2
(45) Date of Patent: Nov. 1, 2022

(54) GARMENT WITH LOW PROFILE MAGNETIC FASTENERS

(71) Applicant: Krystal Dubose, Brooklyn, NY (US)

(72) Inventor: Krystal Dubose, Brooklyn, NY (US)

( * ) Notice: Subject to any disclaimer, the term of this patent is extended or adjusted under 35 U.S.C. 154(b) by 393 days.

(21) Appl. No.: 16/718,979

(22) Filed: Dec. 18, 2019

(65) Prior Publication Data

US 2021/0076751 A1 Mar. 18, 2021

Related U.S. Application Data

(60) Provisional application No. 62/901,887, filed on Sep. 18, 2019.

(51) Int. Cl.
*A41B 9/00* (2006.01)
*A44B 18/00* (2006.01)

(52) U.S. Cl.
CPC ..... *A41B 9/008* (2013.01); *A44B 18/0003* (2013.01); *A44D 2203/00* (2013.01)

(58) Field of Classification Search
CPC ..... A41B 9/008; A41B 18/0003; A41B 9/00; A44D 2203/00; A41F 1/002; A41F 17/00
See application file for complete search history.

(56) References Cited

U.S. PATENT DOCUMENTS

| | | | | |
|---|---|---|---|---|
| 2,727,247 | A | 12/1955 | Bailey | |
| 3,529,328 | A | 9/1970 | Davison | |
| 4,249,267 | A * | 2/1981 | Voss | A41F 1/002 2/121 |
| 4,596,569 | A | 6/1986 | Campbell | |
| 5,276,923 | A | 1/1994 | Cohen | |
| 5,682,653 | A | 11/1997 | Berglof | |
| 7,412,730 | B2 * | 8/2008 | Schroeder | A41F 5/00 2/340 |
| 7,644,489 | B2 * | 1/2010 | Arora | H01F 1/009 335/306 |
| 9,084,448 | B2 | 7/2015 | Keum | |
| 10,165,815 | B1 * | 1/2019 | Branker | A41F 1/008 |
| 10,309,433 | B2 * | 6/2019 | Salvatore | A45C 13/08 |
| 11,134,733 | B2 * | 10/2021 | Miller | A41D 1/06 |
| 11,191,314 | B2 * | 12/2021 | James | A42B 1/24 |

(Continued)

FOREIGN PATENT DOCUMENTS

| | | | |
|---|---|---|---|
| DE | 202013003642 | U1 | 11/2013 |
| JP | 3127044 | U | 11/2006 |
| JP | 2010077581 | A | 4/2010 |

*Primary Examiner* — Robert Sandy
*Assistant Examiner* — Louis A Mercado
(74) *Attorney, Agent, or Firm* — Gloria Tsui-Yip; Gottlieb, Rackman & Reisman, P.C.

(57) ABSTRACT

A garment with low profile fasteners for removable attachment to a top to keep the top tucked in. The fasteners are low-profile, magnetic, and entirely flexible to improve the comfort to a user. Each fastener includes first and second magnetic components that engage each other. The garment can have a generally rectangular shape with fasteners on a first end and a second end. The magnetic components may be embedded within a tab that is fixedly attached to the first and second ends of the garment. The garment can also be a typical undergarment having a waist band, with the first magnetic components of the fasteners embedded in the waist band that cooperatively engage the separate, second magnetic components.

16 Claims, 14 Drawing Sheets

(56) References Cited

U.S. PATENT DOCUMENTS

| | | | | |
|---|---|---|---|---|
| 2006/0282993 | A1* | 12/2006 | Dietz | B43K 23/001 24/303 |
| 2007/0295769 | A1* | 12/2007 | Burroughs | A47G 25/62 223/85 |
| 2009/0265832 | A1* | 10/2009 | Clement | A41C 3/08 2/112 |
| 2012/0324632 | A1* | 12/2012 | Hurvitz | A41B 9/001 2/400 |
| 2013/0313292 | A1* | 11/2013 | Alley | A47G 25/48 223/85 |
| 2015/0040285 | A1 | 2/2015 | Mobayyen | |
| 2015/0089718 | A1 | 4/2015 | Pluta | |
| 2018/0228665 | A1* | 8/2018 | Relekar | A61F 13/505 |
| 2018/0295900 | A1* | 10/2018 | Murphy | A41D 31/18 |

* cited by examiner

GARMENT WITH LOW PROFILE MAGNETIC FASTENERS

This application claims benefit of provisional patent application Ser. No. 62/901,887 filed on Sep. 18, 2019, which is hereby incorporated by reference.

FIELD OF THE INVENTION

The invention relates to a garment that is removably attachable to a top to keep the top tucked in. In particular, the garment has low-profile, magnetic, fasteners for removable attachment to the top.

BACKGROUND OF THE INVENTION

It is often desirable to keep a top tucked into the waistband of a bottom. It is a well-known issue with keeping a top tucked in, especially when a top is short and does not extend long enough below the waistband of a bottom to keep it tucked in. Bodysuits are designed to overcome this issue. However, bodysuits are known to be difficult to fasten, are not practical, and provide limited fashion styles.

While there are prior art clips that are attachable to a top to keep the top tucked in, these prior art clips do not have a low profile and often protrudes and are visible through the bottom. One type of prior art clips are suspender clips that are not only bulgy and rigid, but the claws on the clip often damage the top, especially those made of delicate fabric, and is complicated to attach. Prior art clips that incorporate magnetic components are also known, but often do not grip the top sufficiently to keep the top tucked in or are inflexible such that it affects the comfort of the user. Other prior art clips require engagement of the top therebetween and does not work with thick fabric or is difficult to manipulate over thicker fabric.

Therefore, there is a need of a garment with low profile magnetic fasteners that can easily and effectively keep a top tucked in with minimal damage to the top.

SUMMARY OF THE INVENTION

The present invention is a garment with low profile magnetic fasteners. In one embodiment of the present invention, the garment has a generally rectangular shape having a first end, a second end, and a tapered mid-portion. At each first and second end is at least one fastener. The garment is a panty-like apparel and the at least one fastener is adapted to be removably attachable to a top to allow the top to remain tucked in under the waistband of a bottom that the user is wearing. The fastener is low profile and entirely flexible to improve comfort to the user and minimize its visibility through the bottom.

The fastener of the present invention comprises a pair of tabs with corresponding magnetic components embedded within each tab. The tabs can be made of fabric or other flexible material. The magnetic components can be flexible and/or laminated for additional comfort to the user. When in use, each pair of tabs sandwich a portion of the top therebetween to secure the garment to the top. Fastener(s) on the first end of the garment is attached to the front of the top and fastener(s) on the second end of the garment is attached to the rear of the top.

In another embodiment of the present invention, the garment is a typical undergarment such as underwear, panty hose, garter belt, boxer shorts/briefs, thermal pants, a jock strap, a corset, etc. with a magnetic component provided on the waistband of such undergarment at the front and at the rear. A separate, correspondingly sized, magnetic component engages each magnetic component in the front and in the rear of the undergarment to sandwich a portion of a top therebetween. The magnetic components is flexible and can be laminated for additional comfort to the user.

BRIEF DESCRIPTION OF THE DRAWINGS

Preferred embodiments of the present invention have been chosen for purposes of illustration and description and are shown in the accompanying drawings forming a part of the specification wherein.

DETAILED DESCRIPTION OF THE INVENTION

Figure 1:
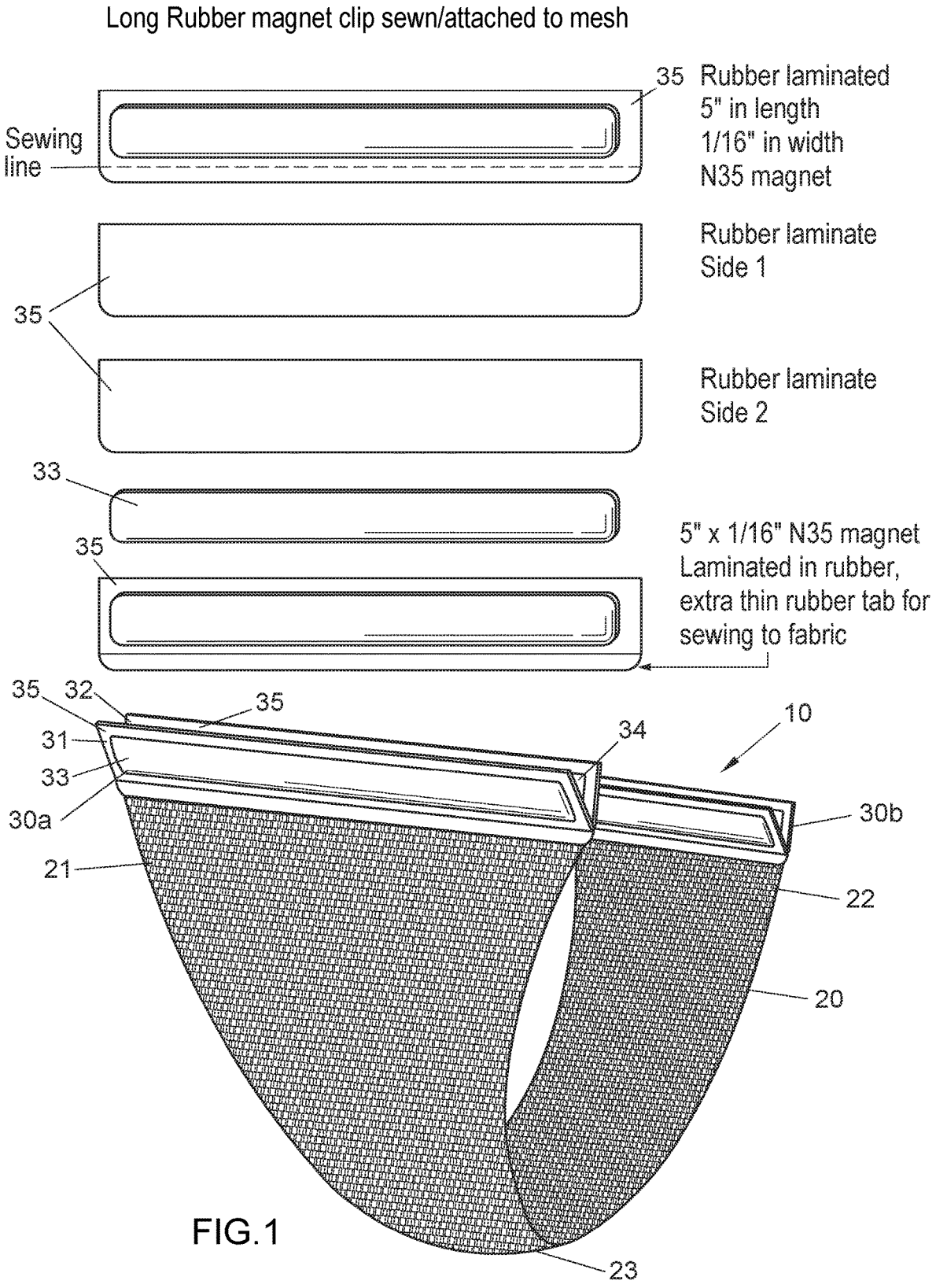
FIG. 1 is a first embodiment of the garment with low profile fasteners of the present invention.

With reference to the drawings, wherein the same reference number indicates the same element throughout, there is shown in FIG. 1 a garment with low profile fasteners 10 of the present invention. The garment with low profile fasteners 10 of the present invention includes a generally rectangular shape garment 20 and two fasteners 30*a* and 30*b*.

The garment 20 has a first end 21 and a second end 22. The generally rectangular shape of the garment 20 may be tapered at a mid-portion 23 between the first end 21 and second end 22 (as shown in FIG. 1) (i.e. to resemble a pair of panties). The generally rectangular shape of the garment 20 can also be tapered from the first end 21 to the second end 22 (i.e. to resemble a thong). However, other elongated, generally rectangular, shape can also be used. The first end 21 and second end 22 can be symmetrically shaped and sized, but not necessary. The first end 21 can be wider than the second end 22 (as shown in FIG. 1), but the first end 21 can also be the same width or narrower than the second end 22. The garment 20 is made of a flexible material such as fabric, plastic, silicone, etc. The garment 20 can be made of natural or synthetic material such as wool, cotton, silk, polyester, nylon, rayon, denim, etc. The material of the garment 20 can be breathable or quick-dry. The material of the garment 20 can be tightly weaved such as fabric or loosely weaved such as a netting or mesh.

A fastener 30*a* is affixed to the first end 21 and a fastener 30*b* is affixed to the second end 22. Each fastener 30*a* or 30*b* comprises a pair of tabs 31 and 32. Tabs 31 and 32 are correspondingly sized and shaped to each other and to the corresponding first end 21 or second end 22. Tabs 31 and 32 can be made of the same type of flexible material as the garment 20 described above. Each tab 31 or 32 contains corresponding magnetic components such as a magnet 33 (e.g. a N35 or N42 magnet) or a ferromagnetic material 34 (e.g. iron or steel plate, or a composite). The magnet 33 and ferromagnetic material 34 can be flexible to further increase the comfort to the user and to conform to the shape of the user's body. The magnetic component 33 or 34 is generally planar, is elongated, and extends substantially the same width as the first end 21 or second end 22. Each magnetic component 33 or 34 is laminated with a rubber coating 35 on one or both of its surfaces. The rubber coating 35 increases the comfort to the user. The magnet 33 and ferromagnetic material 34 can be completely encapsulated within the rubber coating 35 (i.e. both surfaces of the magnet 33 and ferromagnetic material 34 are laminated). Tabs 31 and 32 can be affixed to the first end 21 or second end 22 of the garment 20 by sewing the rubber coating 35 portion to the first end 21 or second end 22 to form the fastener 30. The magnetic components 33 and 34 can be of different size, shape, or thickness, etc. based on the desired flexibility, comfort to the user, and the holding power.

When in use, a portion of a top (not shown) is removably sandwiched and positioned between a pair of tabs 31 and 32 to secure the garment with low profile fasteners 10 to the top. The fastener 30*a* of the garment with low profile fasteners 10 as shown in FIG. 1 can be removably attached to the front of a top, while the fastener 30*b* can be removably attached to the rear of a top. The garment 20 is then positioned across the user's crotch area to keep the top tucked in.

Figure 2:
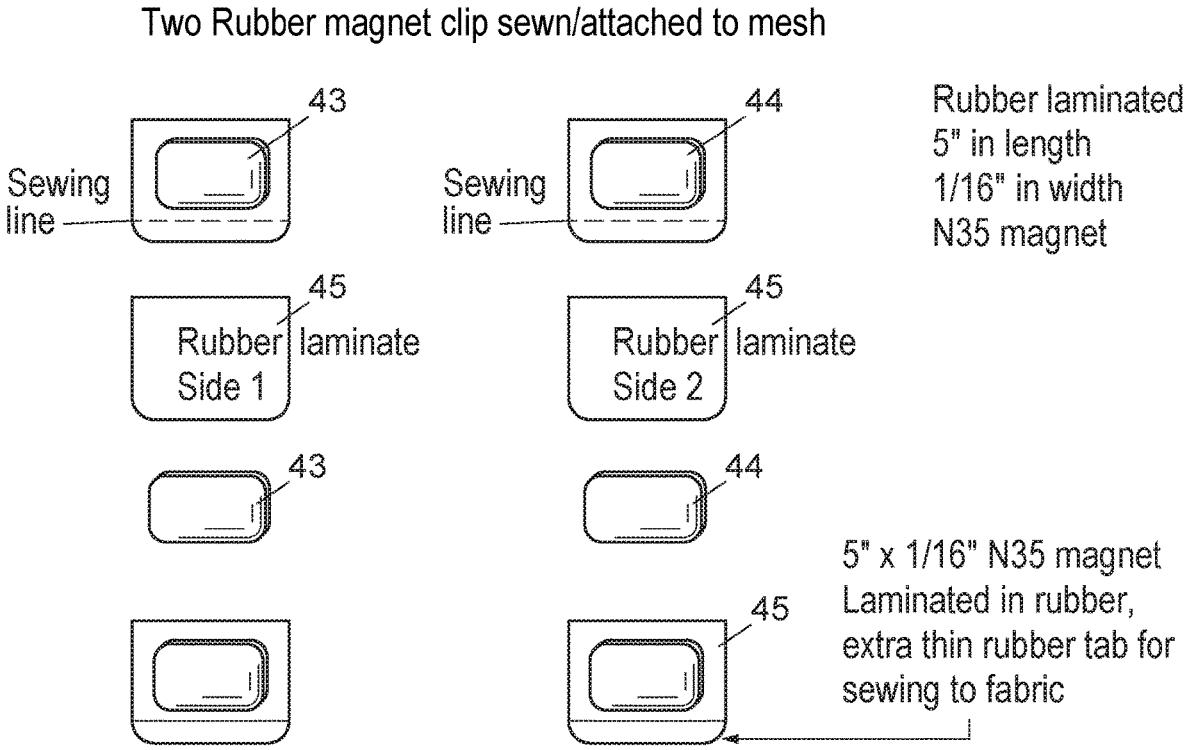
FIG. 2 is a second embodiment of the garment with low profile fasteners of the present invention.
Figure 2:
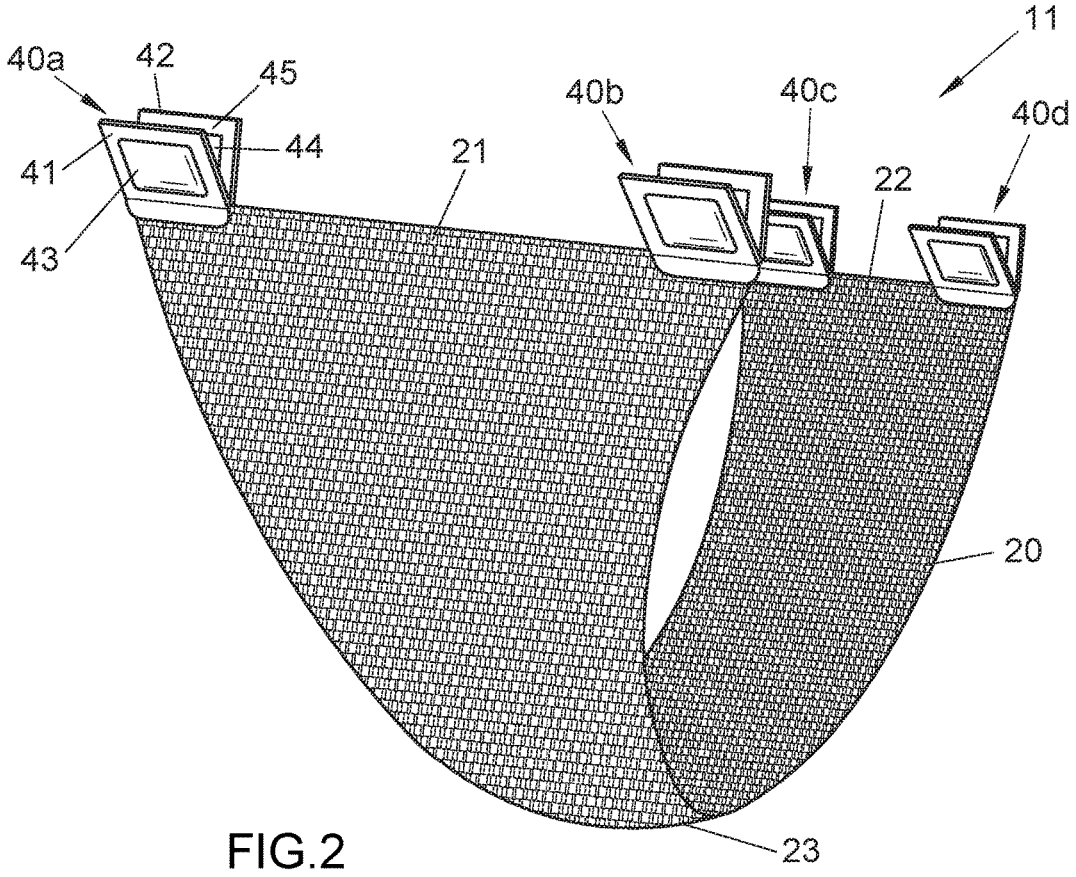

FIG. 2 shows a second embodiment of the garment with low profile fasteners 11 of the present invention, which includes the garment 20 and four fasteners 40*a*, 40*b*, 40*c*, 40*d*. Instead of a single fastener 30*a* affixed to the first end 21 and a single fastener 30*b* affixed to the second end 22, there are two fasteners 40*a* and 40*b* affixed to the first end 21 and two fasteners 40*c* and 40*d* affixed to the second end 22. Fasteners 40*a* and 40*b* are spaced apart and affixed to opposite sides of the first end 21. Similarly, fasteners 40*c* and 40*d* are spaced apart and affixed to opposite sides of the second end 22. Fasteners 40*a*-40*d* are constructed similarly as fasteners 30*a* or 30*b*, with each having a pair of tabs 41 and 42 and magnetic components 43 and 44 laminated under a coating 45, except they are smaller and not as wide. Having two separate fasteners 40*a* and 40*b* (or 40*c* and 40*d*) at the first end 21 (or the second end 22) allows finer adjustment in positioning each fastener 40*a* or 40*b* (or 40*c* or 40*d*) with respect to a top.

Although FIG. 2 shows two fasteners 40*c* and 40*d* affixed to the second end 22, use of only one single fastener 40*c* at the center of the second end 22 (not shown) also works. Similarly, a garment with low profile fasteners of the present invention can have a fastener 30*a* of FIG. 1 at the first end 21 and one or more fasteners 40*c* and/or 40*d* at the second end 22 of the garment 20, or vice versa. A user may choose between one of the garments with lower profile fasteners 10 or 11 (shown in FIG. 1 or 2) depending on the style of the top and the bottom (i.e. whether an elongated magnetic components of fasteners 30*a* and 30*b* or separated, discrete, magnetic components of fasteners 40*a*-40*d* work better with the specific top and bottom of the user).

Figure 3:
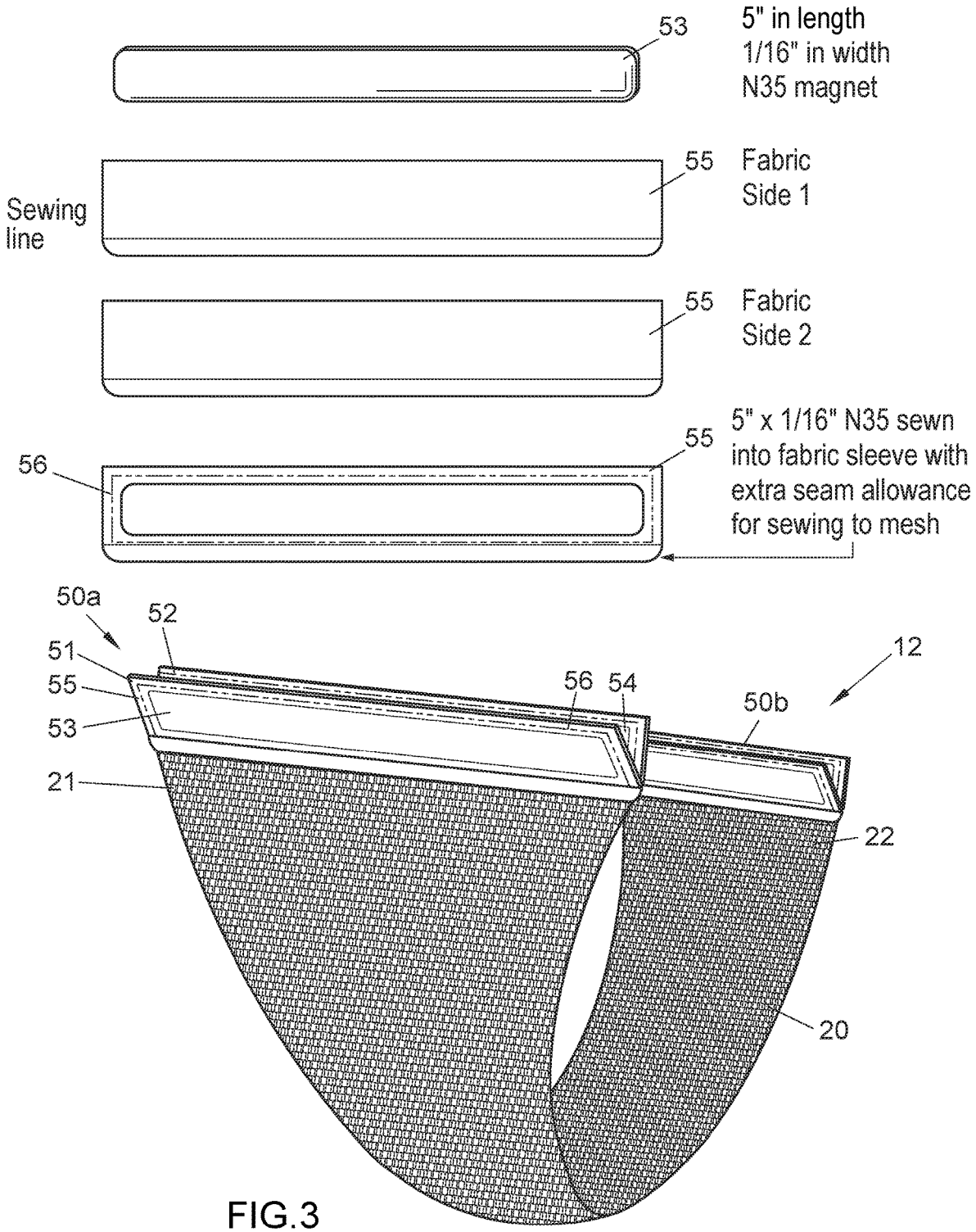
FIG. 3 is a third embodiment of the garment with low profile fasteners of the present invention.

FIG. 3 shows a third embodiment of the garment with low profile fasteners 12 of the present invention. The garment with low profile fasteners 12 is similar to the garment with low profile fasteners 10 of FIG. 1 except that instead of a rubber laminate coating 35, the magnetic components 53 and 54 are placed within a fabric pocket 55 formed from two pieces of fabric to form tabs 51 and 52. The magnetic components 53 and 54 are positioned within each fabric pocket with stitched lines 56. The garment with low profile fasteners 11 of FIG. 2 can similarly be constructed as the garment with low profile fasteners 12 of FIG. 3, using a fabric pocket 55 instead of a rubber laminate coating 45. The fabric pocket 55 can be reinforced with additional layer of fabric, felt, and/or plastic, backing to give it extra strength. Additionally, the surface of the fabric pocket 55 that interacts with the top can have antiskid feature (such as rubberized surface texture) to improve the holding power of the tabs 51 and 52.

Figure 4:
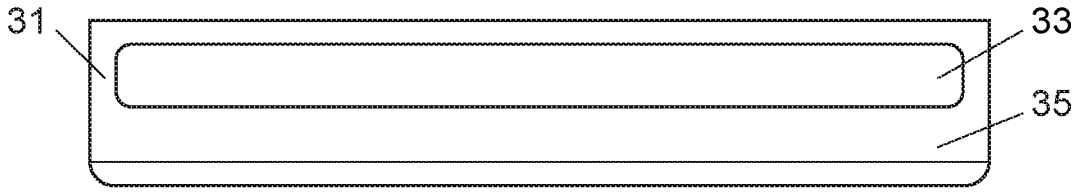
FIGS. 4-6 illustrate various positioning of a magnetic component within a tab of a fastener for the garment with low profile fasteners of the present invention.
Figure 5:
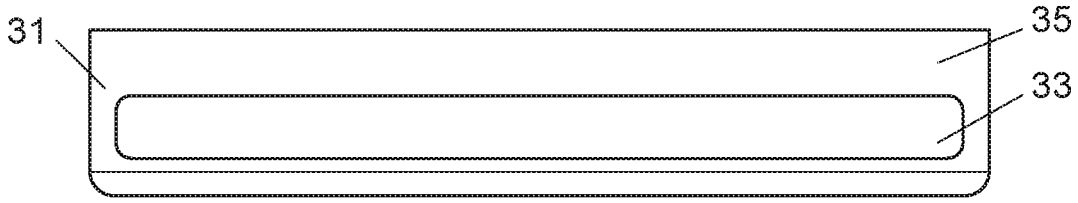
Figure 6:
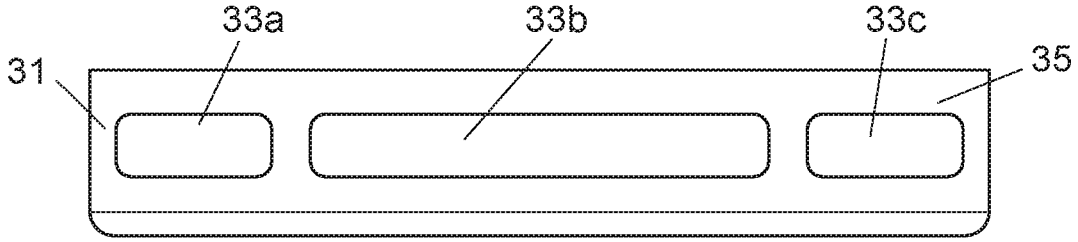

The magnetic components 33, 34, 43, 44, 53, 54 are shown in FIGS. 1-3 as generally centrally positioned within each tab 31, 32, 41, 42, 51, 52, respectively. However, the magnetic component can be positioned at different positions within a tab or include multiple magnetic components in each tab, as illustrated in FIGS. 4-6. FIG. 4 shows a magnet 33 positioned adjacent and closer to a distal end of tab 31. FIG. 5 shows a magnet 33 positioned adjacent and closer to the sewing line where the tab 31 is affixed to a front end 21 of garment 20. FIG. 6 shows three magnets 33*a*, 33*b*, 33*c* that are spaced apart and evenly distributed across tab 31. The use of multiple magnets 33*a*, 33*b*, 33*c* provides additional flexibility and comfort to the user. The magnets 33*a*, 33*b*, 33*c* can have the same or different sizes and shapes. While the magnets 33*a*, 33*b*, 33*c* are shown to be aligned in a row on tab 31, it is not necessarily so, and they can be staggered or not evenly spaced apart or distributed on tab 31.

Figure 7:
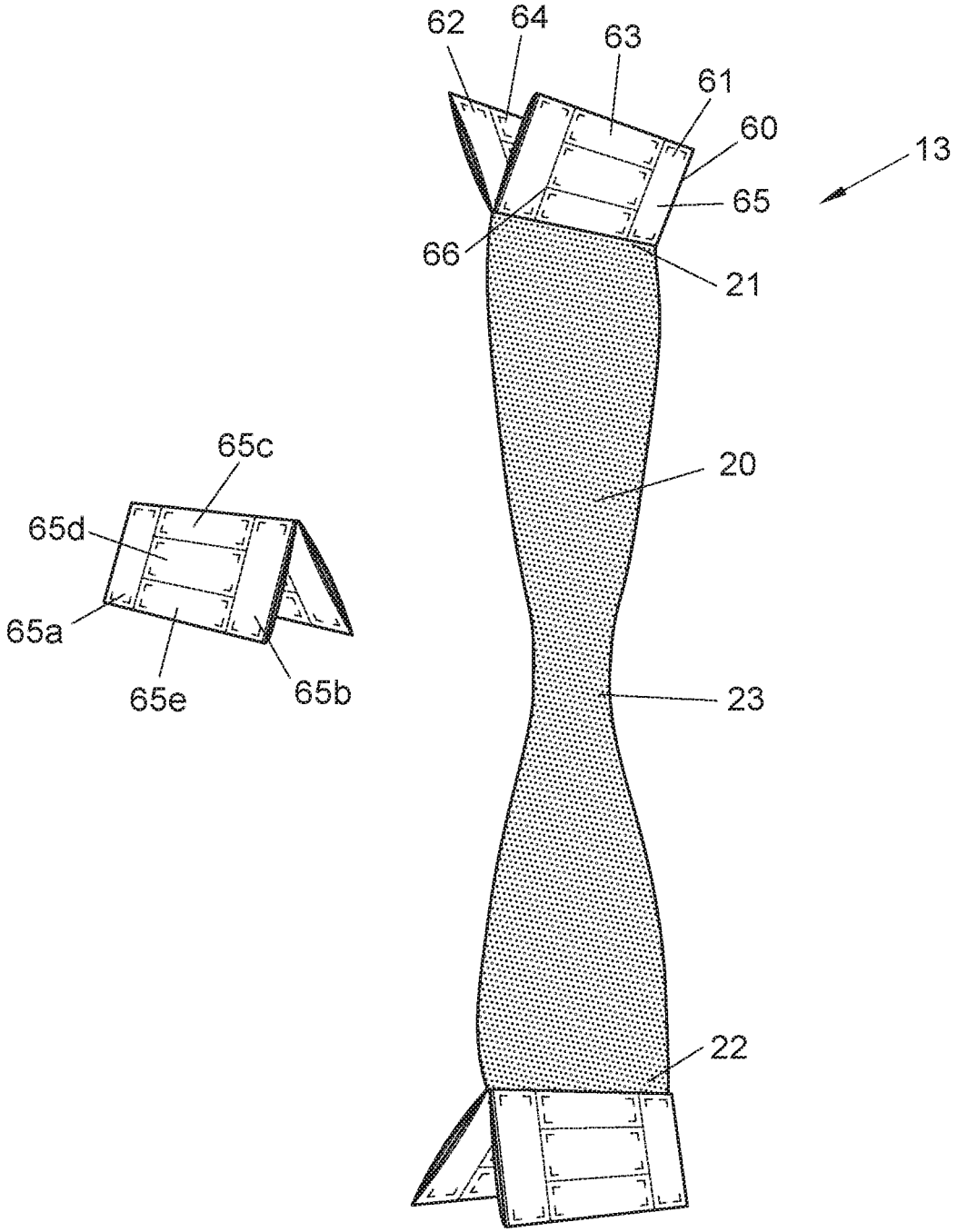
FIG. 7 is a fourth embodiment of the garment with low profile fasteners of the present invention.
Figure 8:
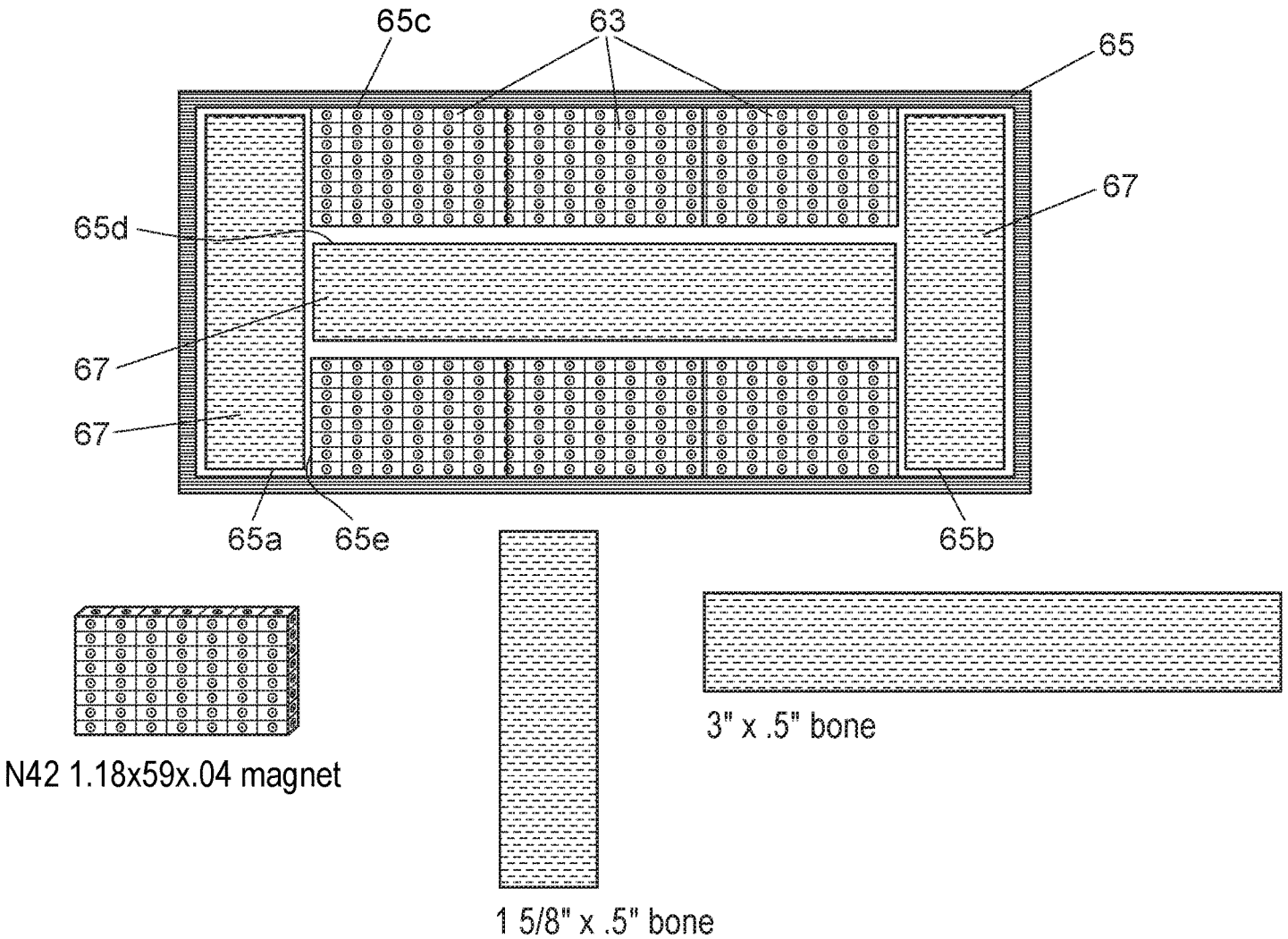
FIG. 8 shows the tab of a fastener of FIG. 7.

FIGS. 7 & 8 show a fourth embodiment of the garment with low profile fasteners 13 of the present invention. The garment with low profile fasteners 13 is similar to the garment with low profile fasteners 12 of FIG. 3 except for the placement and positioning of the magnetic components 63 and 64 in tabs 61 and 62 to form fastener 60. The fabric pocket 65 is segregated into five sections: two vertical sections 65*a* and 65*b* along the left and right edges respectively, and three horizontal sections 65*c*, 65*d*, 65*e* between the two vertical sections 65*a* and 65*b*. One or more magnetic component 63 or 64 are placed in each section 65*c* and 65*e*. FIG. 8 shows that three discrete magnets 63 are placed in each section 65*c* and 65*e*. A piece of bone support 67 is placed in each section 65*a*, 65*b* and 65*d* to provide additional structural support to the tab 61 or 62. Each section 65 is segregated with stitched lines 66 that hold the magnetic components 63 and 64 and bone support 67 within each respective section of the fabric pocket 65. While the fabric pocket 65 is shown to have five sections, it can be segregated into more or less sections, and with various shapes and sizes to accommodate various combination of magnetic components and bone supports.

Figure 9:
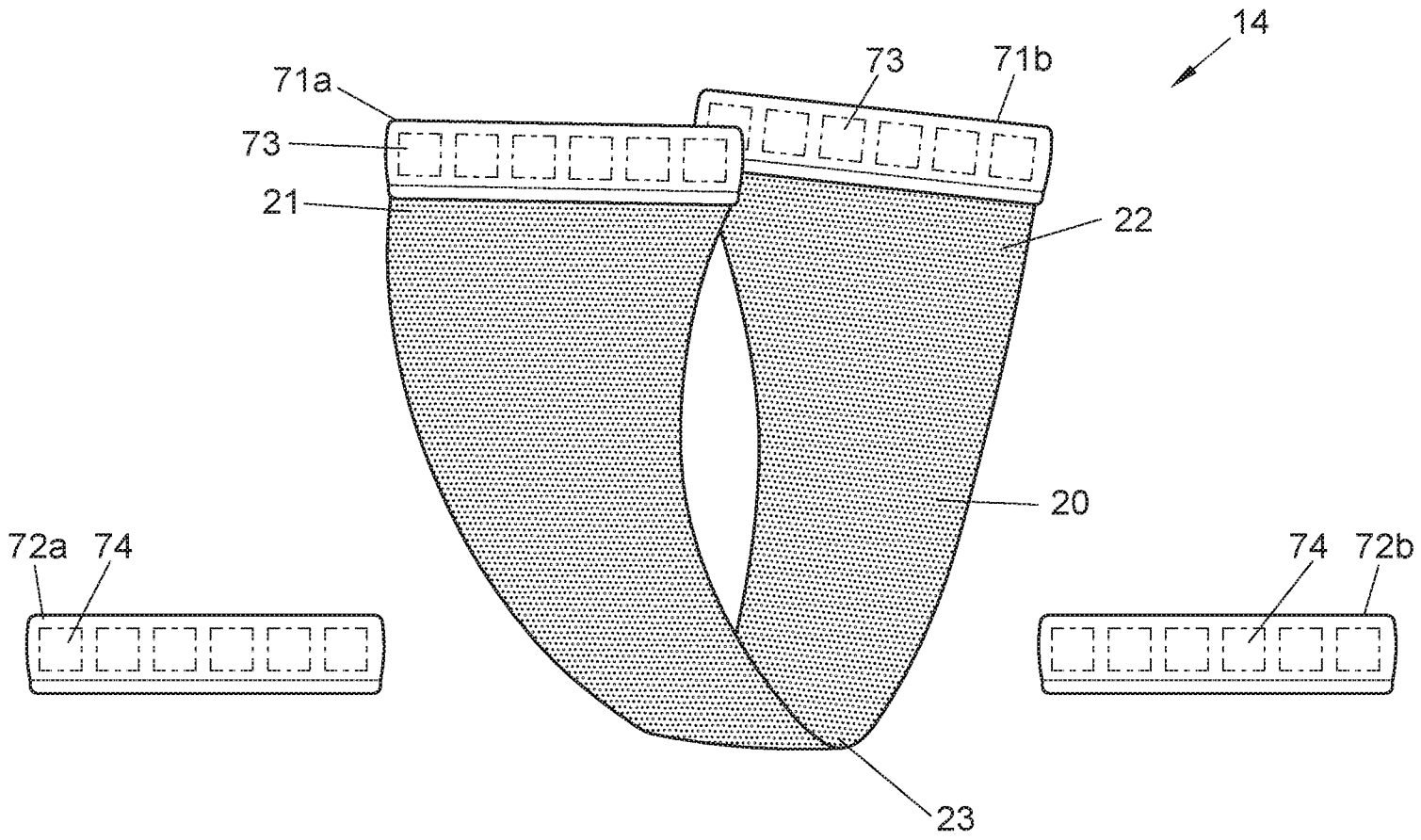
FIGS. 9 and 10 show a fifth embodiment of the garment with low profile fasteners of the present invention.
Figure 10:
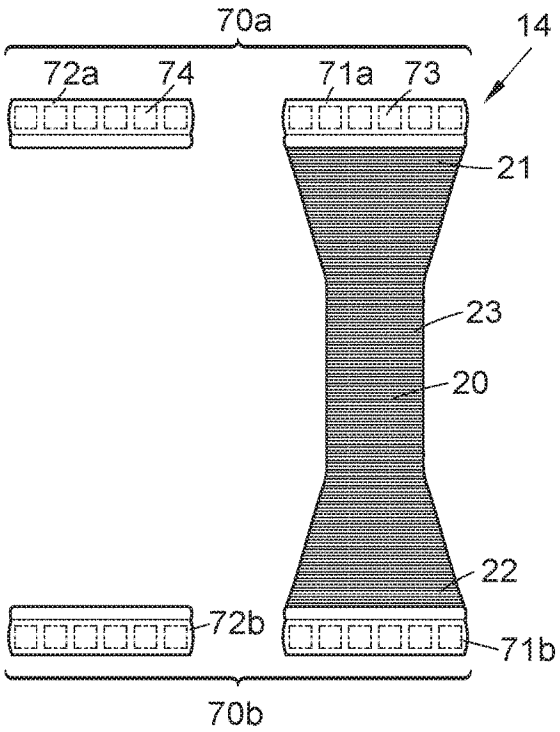

FIGS. 9 & 10 show a fifth embodiment of the garment with low profile fasteners 14 of the present invention. Affixed to the first end 21 of the garment 20 is a tab 71*a* and affixed to the second end 22 of garment 20 is another tab 71*b*. A separate tab 72*a* cooperatively interacts with tab 71*a* to form fastener 70*a*. Similarly, a separate tab 72*b* cooperatively interacts with tab 71*b* to form fastener 70*b*. Tabs 72*a* and 72*b* are separate and are not pre-connected to garment 20 as in the previously described garments with low profile fasteners 10 to 13 of the present invention. Each tab 71*a*, 71*b*, 72*a*, and 72*b* contains a plurality of magnets 73 or ferromagnetic material 74. As shown in the figures, there are six (6) discrete magnets 73 or ferromagnetic material 74 in each tab 71*a*, 71*b*, 72*a*, and 72*b*. The magnets 73 and ferromagnetic material 74 may be embedded in either a laminate or fabric pockets as previously described above in connection with garments with low profile fasteners 10 to 13.

Figure 11:
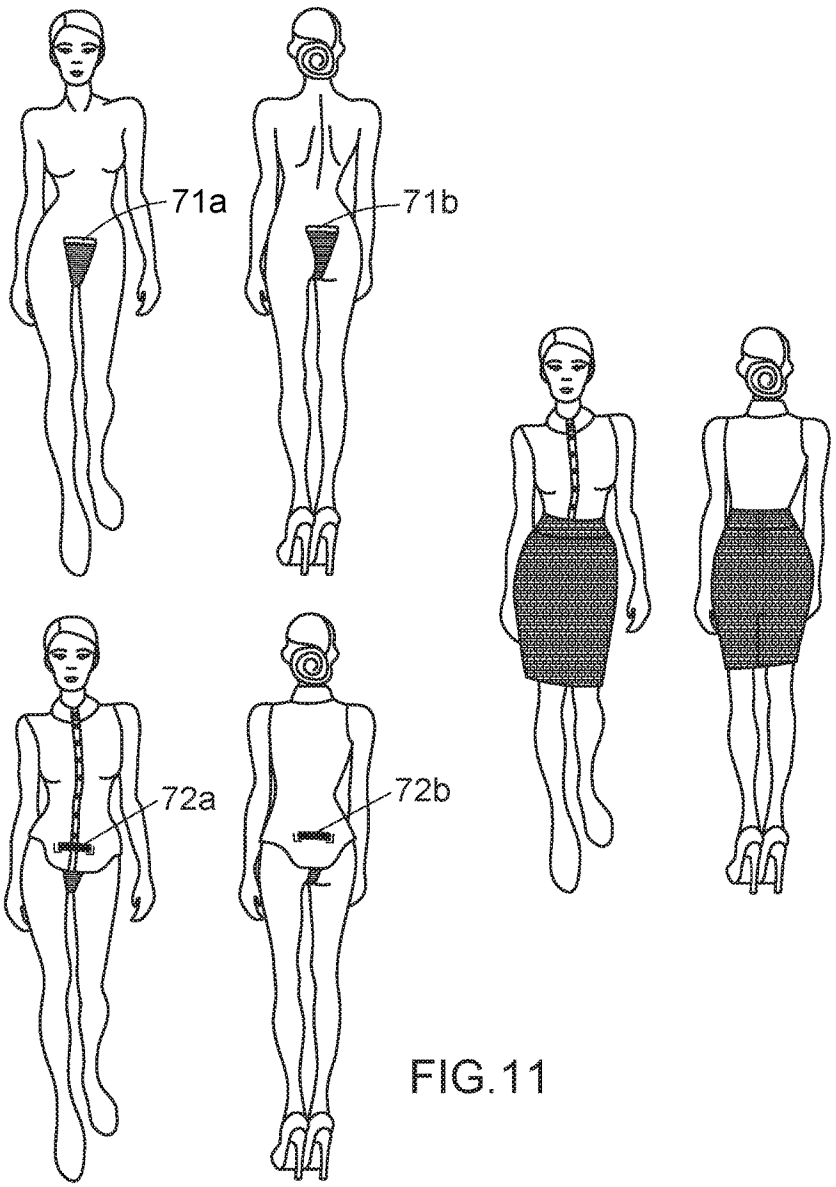
FIG. 11 illustrates the positioning of the fifth embodiment of the garment with low profile fasteners of the present invention when in use.

FIG. 11 illustrates the positioning of the garment with low profile fasteners 14 of the present invention when in use. With the garment 20 positioned across the user's crotch area, tabs 71*a* and 71*b* are positioned between the user's body and the top. Tab 72*a* and 72*b* are then placed over the top and directly in front of tab 71*a* and 71*b* respectively, thereby sandwiching a portion of the top therebetween. The fasteners 70*a* and 70*b* may be adjusted to a comfortable and ideal position for the user by adjusting positions of the tabs 71*a*, 71*b*, 72*a*, and 72*b* with respect to the top. Once the fasteners 70*a* and 70*b* are secured to the top, the user can then wear a bottom over the garment with low profile fasteners 14, where the fasteners 70*a* and 70*b* are positioned below the waistband and do not protrude nor are visible through the bottom.

Figure 12A:
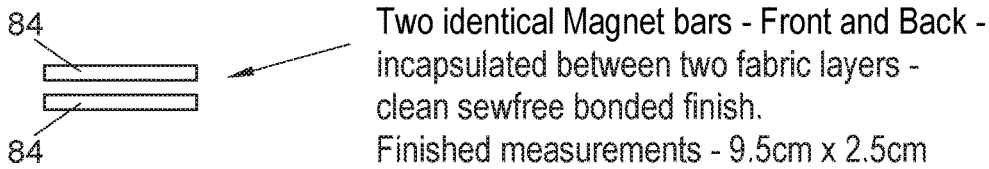
FIGS. 12A and 12B show a front view and a rear view of a sixth embodiment of the garment with low profile fasteners of the present invention.
Figure 12A:
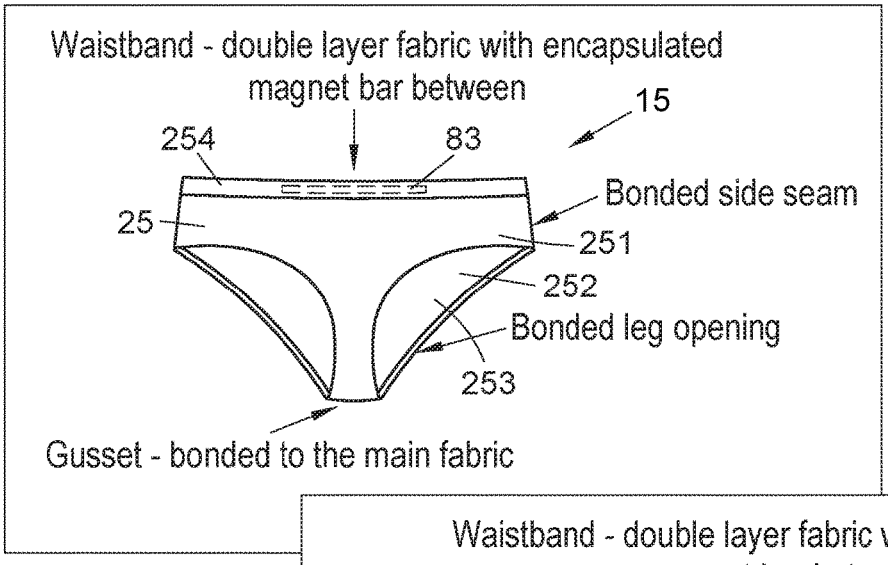
Figure 12B:
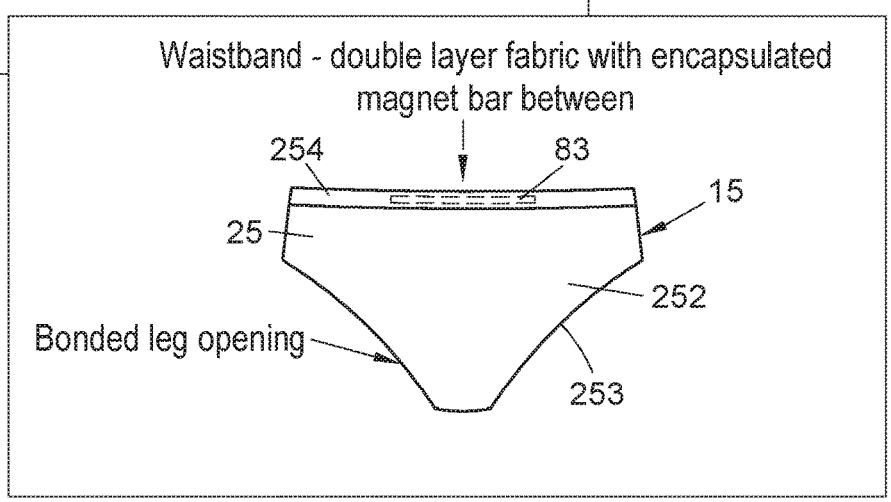

FIGS. 12A and 12B show a sixth embodiment of the garment with low profile fasteners 15 of the present invention. Garment 25 is a typical pair of panties or briefs having a front portion 251, a rear portion 252, a pair of leg openings 253, and an elastic waist band 254. Along the waist band 254 in the front portion 251 and in the rear portion 252 is a magnetic component (either a magnet 83 or a ferromagnetic material 84). A separate corresponding magnetic component (either a ferromagnetic material 84 or magnet 83) interacts with the magnetic component 83 or 84 along the waist band 254 to form fastener 80*a* in the front portion and fastener 80*b* in the rear portion of the panties or briefs 25. FIGS. 12A and 12B show a magnet 83 in each of the front portion 251 and rear portion 252 along the waist band 254, with the separate ferromagnetic material 84. The magnetic component 83 or 84 is flexible and is encapsulated in the waist band 254. The magnetic component 83 or 84 additionally may be embedded in either a laminate or fabric pockets as previously described above in connection with garments with low profile fasteners 10 to 14 for additional comfort to the user. While FIGS. 12A and 12B show a single magnetic component 83 or 84, it can be replaced with multiple discrete magnetic components as described above in connection with garments with low profile fasteners 10 and 14.

Figure 13A:
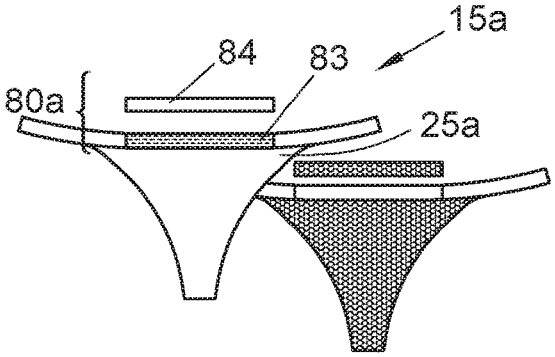
FIGS. 13A, 13B, 14A, 14B, 15A and 15B show variations of the sixth embodiment of the garment with low profile fasteners of the present invention.
Figure 13B:
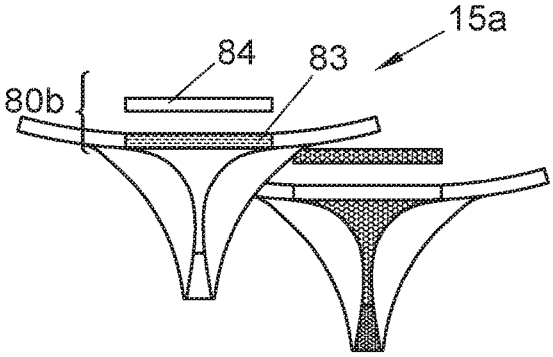
Figure 14A:
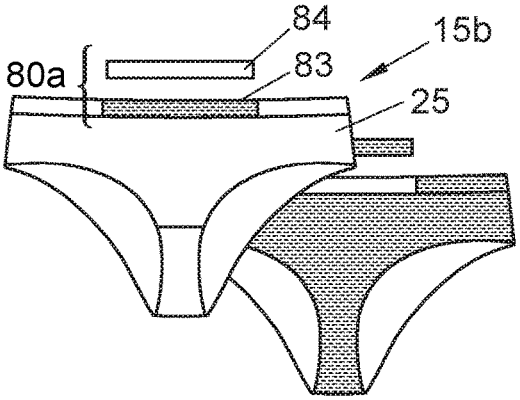
Figure 14B:
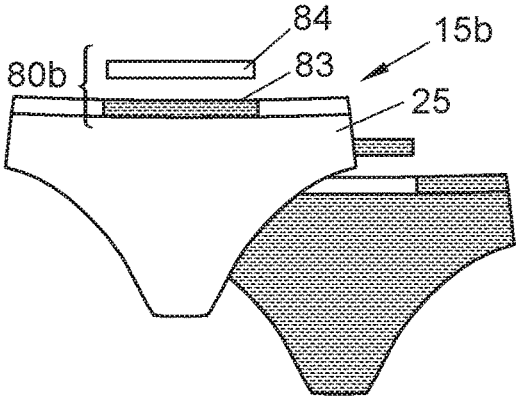
Figure 15A:
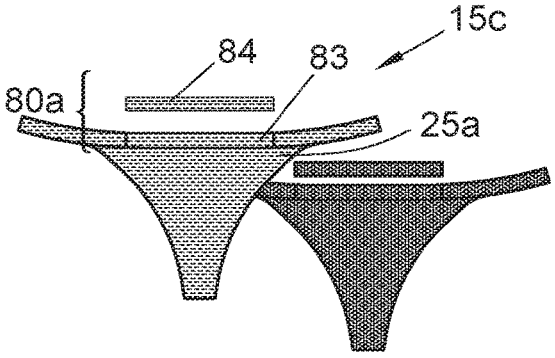
Figure 15B:
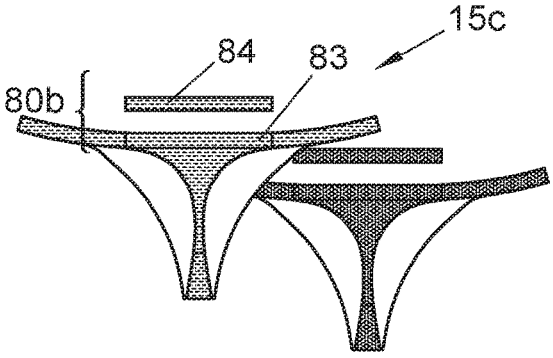

FIGS. 13A-15B show front and rear views of different variations of the garment with low profile fasteners 15 of FIGS. 12A and 12B. Instead of a pair of panties or briefs 25, garment with low profile fasteners 15*a* of FIGS. 13A and 13B is a thong underwear 25*a*. The ferromagnetic material 84 may be covered or embedded in a laminate or fabric having the same color and/or pattern as the thong underwear 25*a*. Garment with low profile fasteners 15*b* of FIGS. 14A and 14B is a pair of panties or briefs 25 as shown in FIGS. 12A and 12B with the ferromagnetic material 84 covered or embedded in a laminate or fabric having the same corresponding color as the pair of panties or briefs 25. Similarly, garment with low profile fasteners 15*c* of FIGS. 15A and 15B is a thong underwear 25*a* with the ferromagnetic material 84 covered or embedded in a laminate or fabric having the same corresponding color as the thong underwear 25*a*. Instead of being covered or embedded in a laminate or fabric, ferromagnetic material 84 may be printed or painted to correspond to the color and/or pattern of the garment 25 or 25*a*. The matching ferromagnetic material 84 to the garment 25 or 25*a* advantageously aid in concealing/camouflaging the presence of the magnetic components 83 or 84.

Figure 16:
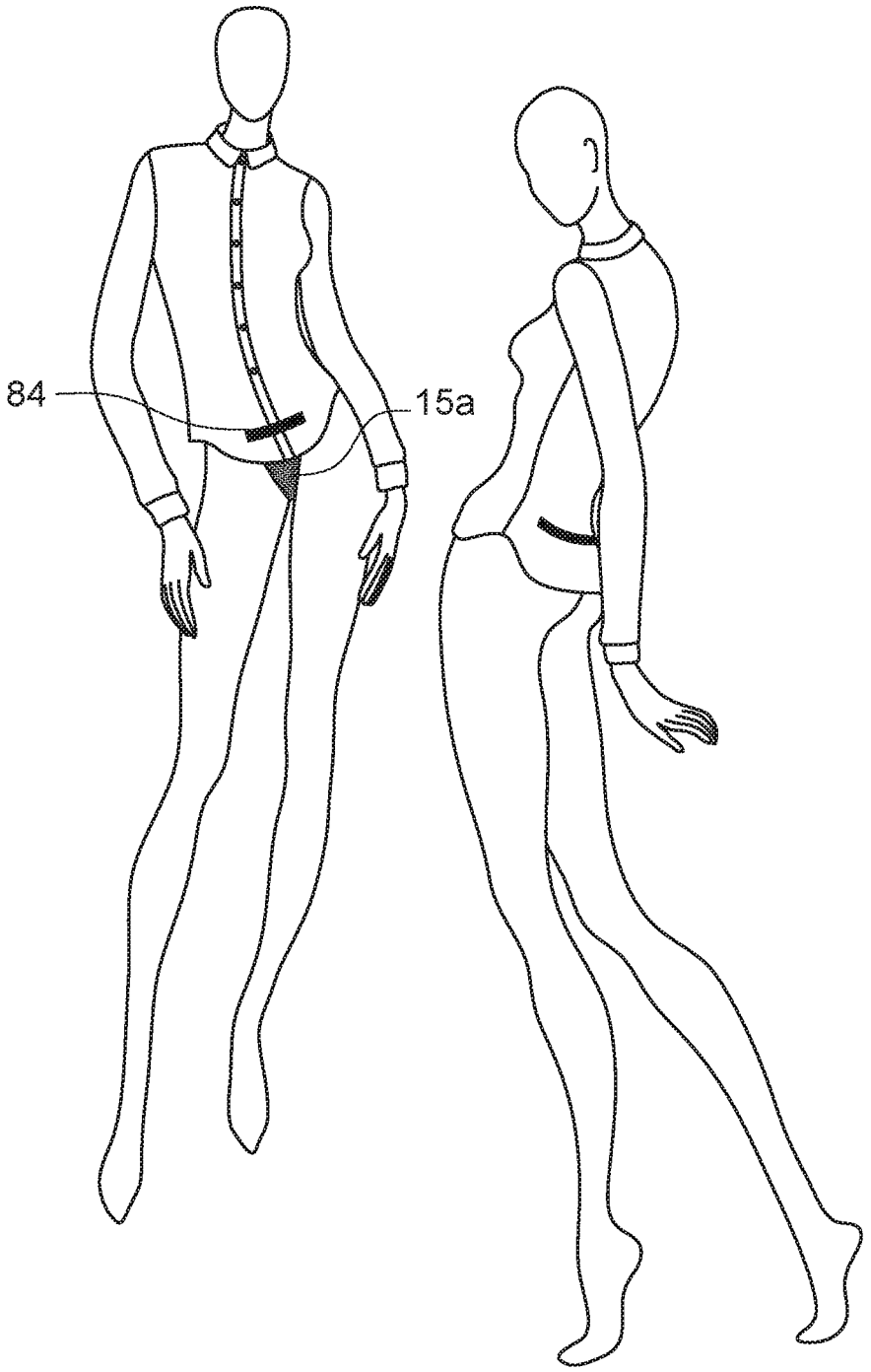
FIG. 16 illustrates the positioning of the sixth embodiment of the garment with low profile fasteners of the present invention when in use.

As shown in FIG. 16, similar to fasteners 70*a* and 70*b* of FIGS. 9-11, fasteners 80*a* and 80*b* each sandwiches a portion of a top between each fastener 80*a* and 80*b*. The incorporation of low profile fasteners 80*a* and 80*b* into a typical panties 25 or thong underwear 25*a* advantageously facilitates the ease of use of the present invention. A user can put on the panties 25 or thong underwear 25 normally with the panties 25 or thong underwear 25*a* staying put on the user, which makes it easier to adjust and position the magnetic component 83 or 84 over the top for the most desirable comfort and positioning.

Figure 17:
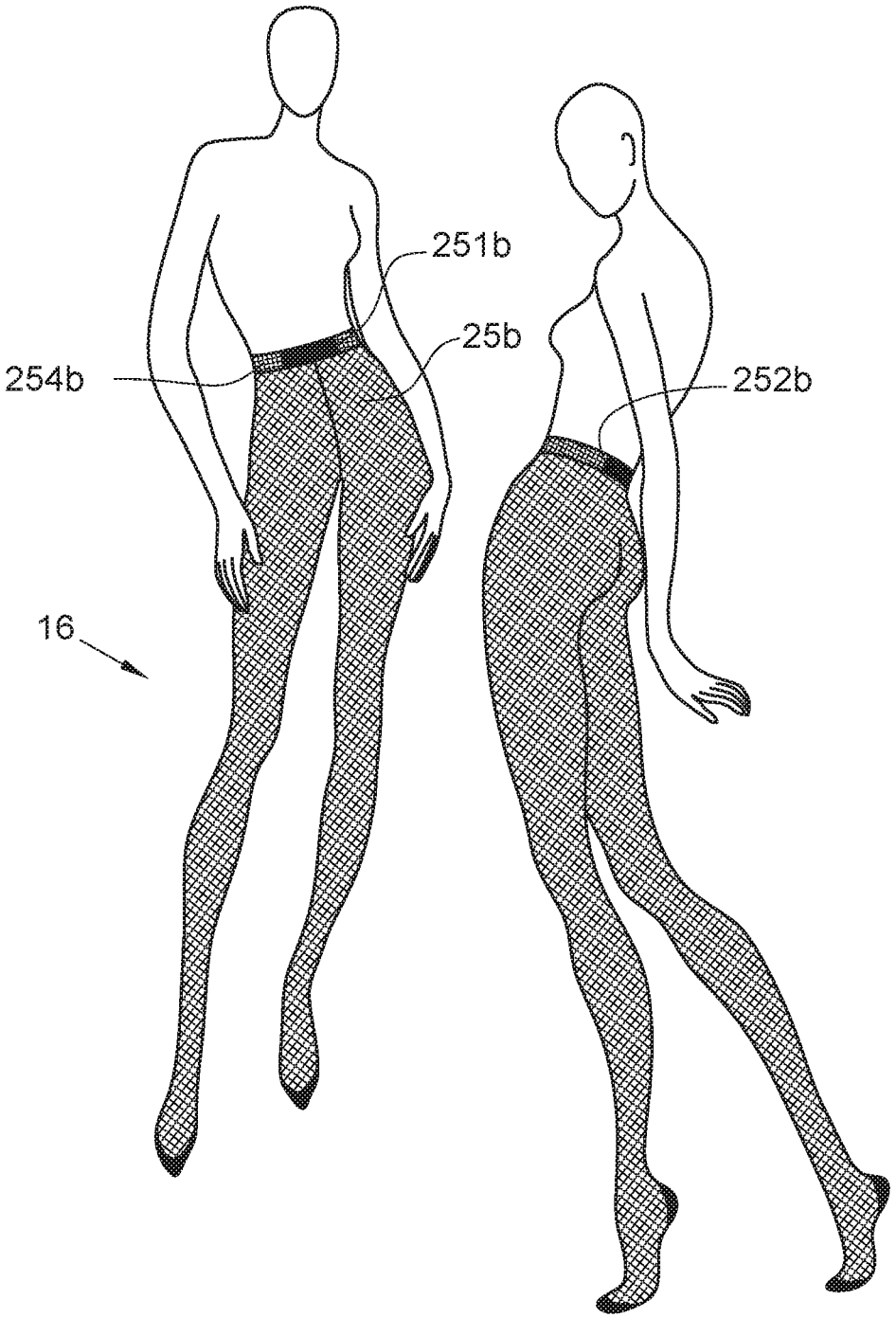
FIG. 17 is a seventh embodiment of the garment with low profile fasteners of the present invention.

FIG. 17 shows a seventh embodiment of the garment with low profile fasteners 16 of the present invention. Garment 25*b* is a typical pair of pantyhose having an elastic waist band 254 as the panties or briefs 25 shown in FIGS. 12A and 12B. Similar to the garment with low profile fasteners 15 of FIGS. 12A and 12B, along the waist band 254*b* in the front portion 251*b* and rear portion 252*b* is a magnetic component (either a magnet 83 or a ferromagnetic material 84). A separate corresponding magnetic component (either a ferromagnetic material 84 or magnet 83) interacts with the magnetic component 83 or 84 along the waist band 254*b* to form fastener 80*a* in the front portion and fastener 80*b* in the rear portion of the pantyhose 25*b*. Fasteners 80*a* and 80*b* may be color and/or pattern coordinated with the remaining part of the pantyhose 25*b*.

Figure 18:
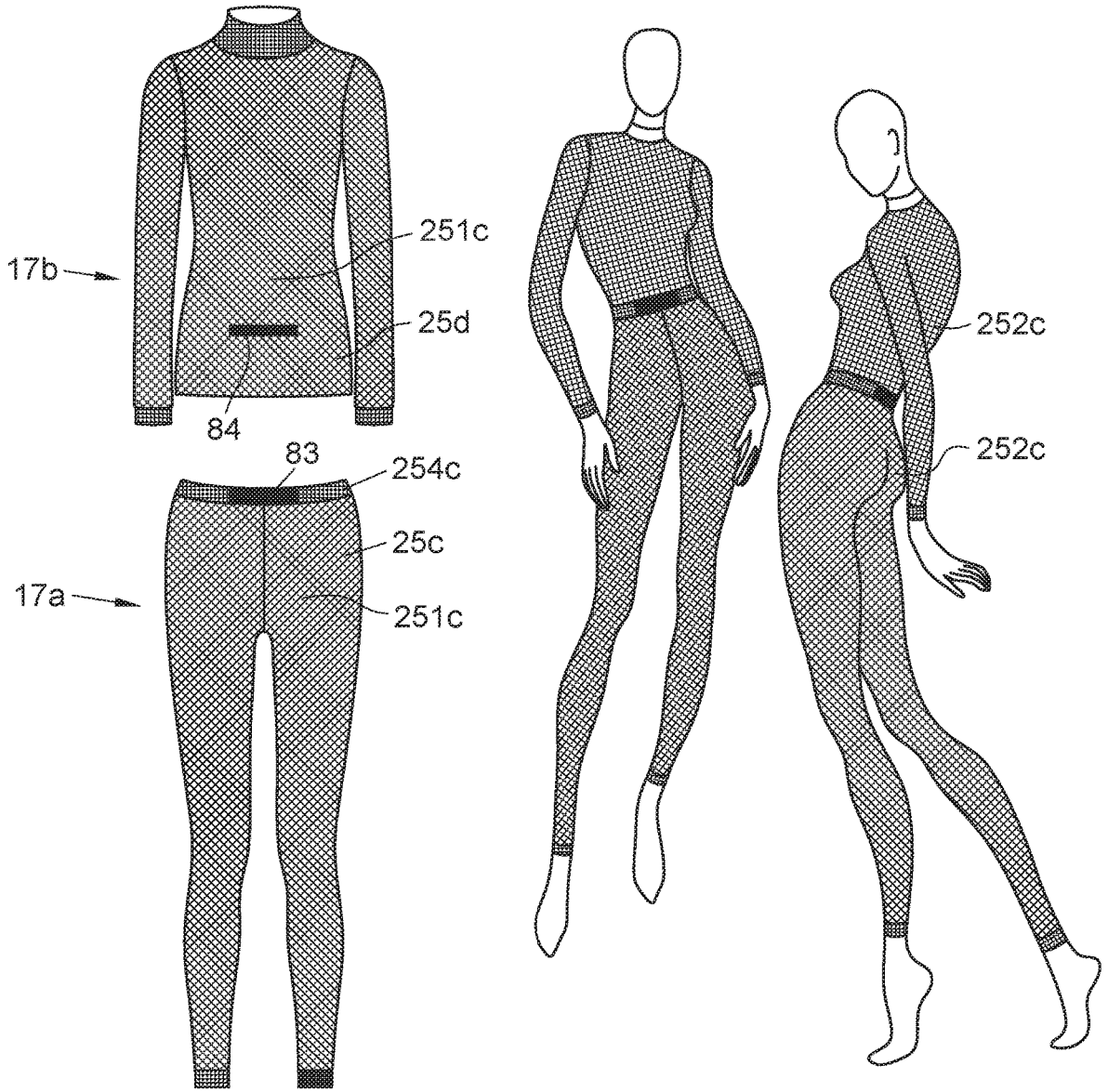
FIG. 18 is an eighth embodiment of the garment with low profile fasteners of the present invention.

FIG. 18 shows an eighth embodiment of the garment with low profile fasteners 17*a* and 17*b* of the present invention. Garment 25*c* is a pair of thermal pants and garment 25*d* is a thermal top, which cooperatively work as a set. Garment 25*c* has an elastic waist band 254*c* as in garment 25, 25*a*, and 25*b* having a magnetic component (either a magnet 83 or a ferromagnetic material 84) at the front portion 251*c* and the rear portion 252*c*. Garment 25*d* has a corresponding magnetic component (either a ferromagnetic material 84 or magnet 83) in each of the front portion 251*c* and rear portion 252*c* that interacts with the magnetic component 83 or 84 along the waist band 254*c* to form fastener 80*a* in the front portion and fastener 80*b* in the rear portion of the thermal pants 25*c* and thermal top 25*d*. Fasteners 80*a* and 80*b* may be color and/or pattern coordinated with the garments 25*c* and 25*d*.

Figure 19A:
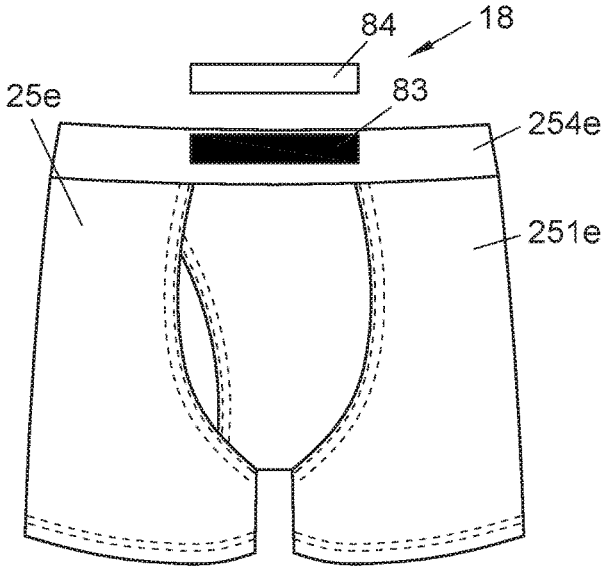
FIGS. 19A and 19B show a front view and a rear view of a ninth embodiment of the garment with low profile fasteners of the present invention.
Figure 19B:
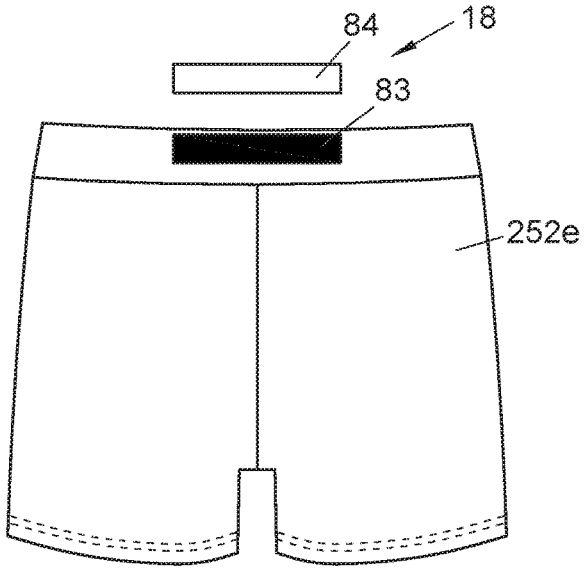

FIGS. 19A and 19B show a ninth embodiment of the garment with low profile fasteners 18 of the present invention. Garment 25*e* is a typical pair of boxer briefs having a front portion 251*e*, a rear portion 252*e*, and an elastic waist band 254*e*. Garment with low profile fasteners 18 is substantially similar to the garment with low profile fasteners 15-17 of FIGS. 12A to 18, having the same features and constructions.

Figure 20A:
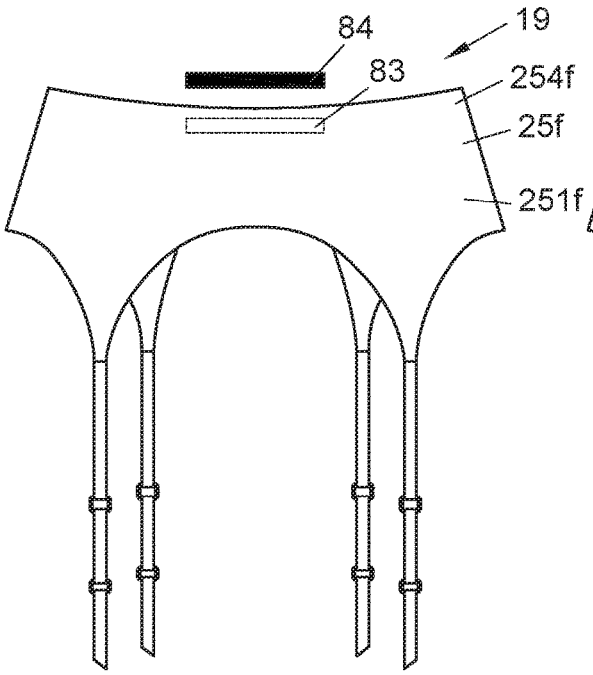
FIGS. 20A and 20B show a front view and a rear view of a tenth embodiment of the garment with low profile fasteners of the present invention.
Figure 20B:
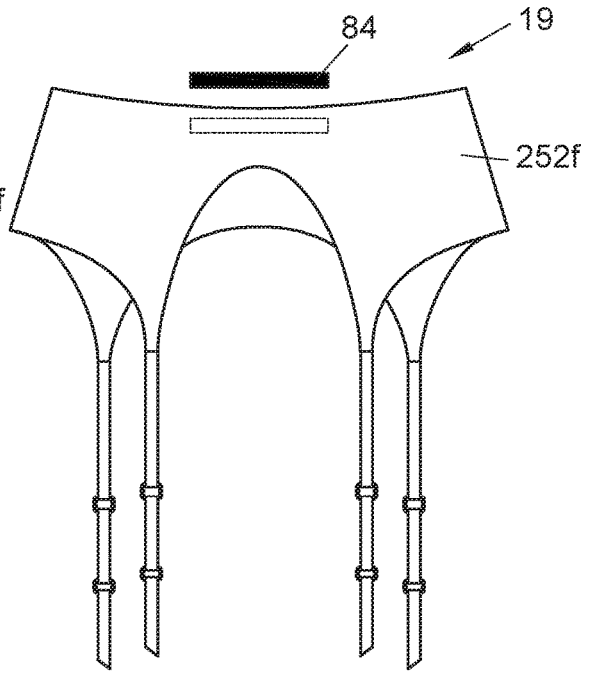

FIGS. 20A and 20B show a tenth embodiment of the garment with low profile fasteners 19 of the present invention. Garment 25*f* is a typical garter belt having a front portion 251*f*, a rear portion 252*f*, and an elastic waist band 254*f*. Garment with low profile fasteners 19 has the same features and constructions as the garment with low profile fasteners 15-18 as shown in FIGS. 12A to 19B.

Magnets 33, 43, 53, 63, 73, or 83 for the fasteners of the present invention described above may be a neodymium (NdFeB) magnet having the following dimension, 15 mm×15 mm×1 mm thick. The magnets can be grade N35, nickel (Ni—Cu—Ni) plated, and magnetized through the 1 mm thickness. Magnets from grade N35 to N52 can be used. A generally uniform thickness of about 1 mm provides adequate flexibility and comfort to a user while maintaining the ability to act as an effective fastener. The length and width of the magnet can vary, such as more elongated, 15 mm×30 mm×1 mm, or smaller, 7 mm×7 mm×1 mm, but any size between these dimensions would work. Further, multiple magnets sized 15 mm×15 mm×1 mm, or 7 mm×7 mm×1 mm can be used adjacent each other as previously described above. The corresponding ferromagnetic material is corresponding sized as the magnets.

The garment with low profile fasteners of the present invention advantageously allows the easy, removable, and secure attachment of the fastener to a top to keep the top tucked in. The configuration and structure of the garment with low profile fasteners of the present invention overcome the shortcomings of prior art designs.

The features of the invention illustrated and described herein are the preferred embodiments. Therefore, it is understood that the specification is intended to cover unforeseeable embodiments with insubstantial differences that are within the spirit of the specification.

What I claim is:

1. A garment with low profile fasteners for removable attachment to a top worn by a user, comprising:

a garment with a generally rectangular shape having a first end, a second end, and a tapered mid-portion between said first and second ends; and at least one fastener at each of said first and second ends adapted to be removably attachable to the top, each of said fastener comprises a first magnetic component and a corresponding second magnetic component that engages said first magnetic component;

wherein the top is adapted to be sandwiched between said first and second magnetic components for removable attachment to each of said fastener; and wherein said fastener in its entirety, including said first and second magnetic components, is made of a flexible material for conforming to the top and the user;

wherein each of said first and second magnetic components is embedded in a corresponding first and second tabs that are fixedly attached to said first and second ends of said garment; and wherein each of said first and second tabs further comprises at least one bone support to provide additional structural support to said first and second tabs.

2. The garment with low profile fasteners of claim 1, wherein each of said first and second magnetic components is uniformly planar.

3. The garment with low profile fasteners of claim 1, wherein said first and second magnetic components have corresponding shape and size.

4. The garment with low profile fasteners of claim 1, wherein each of said first and second magnetic components is laminated with a rubber coating.

5. The garment with low profile fasteners of claim 1, wherein said first magnetic component comprises one or more distinct magnets.

6. The garment with low profile fasteners of claim 1, wherein said second magnetic component comprises one or more distinct ferromagnetic material.

7. The garment with low profile fasteners of claim 1 comprising two fasteners at each of said first and second ends of said garment that are spaced apart from each other.

8. The garment with low profile fasteners of claim 1, wherein said first and second tabs are made of fabric.

9. A garment with low profile fasteners for removable attachment to a top worn by a user, comprising:

a garment having a front portion, a rear portion, and a waistband; and at least one fastener at each of said front and rear portions adapted to be removably attachable to the top, each of said fastener comprises a first magnetic component and a corresponding second magnetic component that engages said first magnetic component;

wherein the first magnetic component is fixedly positioned within said waistband at each of said front and rear portions;

wherein the top is adapted to be sandwiched between said first and second magnetic components for removable attachment to each of said fastener;

wherein said fastener in its entirety, including said first and second magnetic components, is made of a flexible material for conforming to the top and the user;

wherein said second magnetic component is embedded in a tab; and wherein said tab comprises at least one bone support to provide structural support to said tab.

10. The garment with low profile fasteners of claim 9, wherein said garment is selected from the group consisting of: a pair or panties, a pair of briefs, a thong underwear, a pair of pantyhose, a thermal pants, a boxer brief, a garter belt, and a jock strap.

11. The garment with low profile fasteners of claim 9, wherein each of said first and second magnetic components is uniformly planar.

12. The garment with low profile fasteners of claim 9, wherein said first and second magnetic components have corresponding shape and size.

13. The garment with low profile fasteners of claim 9, wherein each of said first and second magnetic components is laminated with a rubber coating.

14. The garment with low profile fasteners of claim 9, wherein said first magnetic component comprises one or more distinct magnets.

15. The garment with low profile fasteners of claim 9, wherein said second magnetic component comprises one or more distinct ferromagnetic material.

16. The garment with low profile fasteners of claim 9, wherein said second magnetic component is adapted to fixedly position on the top.

* * * * *